US006824500B2

(12) United States Patent
Park et al.

(10) Patent No.: US 6,824,500 B2
(45) Date of Patent: Nov. 30, 2004

(54) SPHINCTER EXERCISER

(76) Inventors: Nam-Young Park, 105-1703 Sungwon Apartment 45-1 Sangnam-dong, Changwon City, Gyeongsangnam-do 641-778 (KR); Min-Chae Jung, 102-1205 Samsung Buckinggung Apts. 148-3 Yangdeok-dong, Masan City, Gyeongsangnam-do 630-490 (KR)

( * ) Notice: Subject to any disclaimer, the term of this patent is extended or adjusted under 35 U.S.C. 154(b) by 0 days.

(21) Appl. No.: 10/476,517

(22) PCT Filed: Apr. 30, 2002

(86) PCT No.: PCT/KR02/00809

§ 371 (c)(1),
(2), (4) Date: Oct. 29, 2003

(87) PCT Pub. No.: WO02/087705

PCT Pub. Date: Nov. 7, 2002

(65) Prior Publication Data

US 2004/0132582 A1 Jul. 8, 2004

(30) Foreign Application Priority Data

Apr. 30, 2001 (KR) ..... 2001-23368

(51) Int. Cl.[7] ..... A63B 23/04

(52) U.S. Cl. ..... 482/51; 482/123; 482/147; 601/23

(58) Field of Search ..... 482/51–53, 79–80, 482/148, 121–123, 129–130; 601/23–35

(56) References Cited

U.S. PATENT DOCUMENTS 4,220,329 A * 9/1980 Agyagos ..... 482/147
4,515,363 A * 5/1985 Schleffendorf ..... 482/100
4,560,165 A * 12/1985 Witteman et al. ..... 473/269
6,740,011 B1 * 5/2004 Tsai et al. ..... 482/80

FOREIGN PATENT DOCUMENTS

JP 3045397 11/1997

OTHER PUBLICATIONS

Japanese patent Appl Publication No. 7–67981 (Mar. 14, 1995).

Japanese patent Appl Publication No. 61–154584 (Jul. 14, 1986).

Japanese Utility model Applcations Publication No. 62–72662 (May 9, 1987).

* cited by examiner

*Primary Examiner*—Stephen R. Crow
(74) *Attorney, Agent, or Firm*—Galgano & Burke, LLP

(57) ABSTRACT

The present invention provides a sphincter exerciser for strengthening the sphincters of persons in an effort to prevent diseases, such as aconuresis or encopresis caused by weak sphincters. This sphincter exerciser consists of a body (10), which has two depressions (4), two hinge holes (6) and a window (8). Two footholds (20) are hinged to the two hinge holes (6) by means of two hinge shafts (18). A roller (30) is shafted to the roller bracket (14) of each foothold (20), and is laid on the inclined bottom of an associated depression (4). The exerciser also has a momentum adjuster (40), which is installed in the body (10) and allows a user to adjust momentum while exercising. This momentum adjuster (40) has an adjusting block, two guide rollers (38), a wire (46), and a coil spring (48) connected to the hinge shafts (18) by the wire (46).

3 Claims, 2 Drawing Sheets

SPHINCTER EXERCISER

TECHNICAL FIELD

The present invention relates generally to a sphincter exerciser, and more particularly, to a sphincter exerciser for strengthening the sphincters of persons in an effort to prevent conditions, such as aconuresis or encopresis caused by weak sphincters.

BACKGROUND ART

Generally, a sphincter is defined as muscle which encircles a tubular organ of the body, such as the anus and the urethra, and normally maintains constriction of the organ and relaxes as required. Usually, the sphincter is weakened by pregnancy, childbirth, and increasing age.

When the sphincter is weakened, it cannot be constricted and relaxed as desired. Thus, in the case where a person with a weak sphincter exercises or laughs, the person may undergo aconuresis or encopresis, and so may suffer pain and feel stress.

Therefore, there have been developed and used exercisers for preventing conditions, such as aconuresis or encopresis caused by weak sphincters, that is, various kinds of sphincter exercisers for strengthening sphincters. A conventional sphincter exerciser includes a fastening nut having an internally-threaded tubular body provided with a hollow chamber. An O-ring for sealing the fastening nut and a top cap are mounted to the fastening nut. A screw hole is formed on a bottom wall of the body. A sealing rod to which a pulling string is fixed is screwed to the screw hole with a setscrew. Further, a friction part is formed on the bottom wall of the body and receives a magnetic ball. In this case, the magnetic ball is made of a substance increasing friction sound and radiating far infrared rays.

However, the conventional sphincter exerciser has a problem that it is designed to be inserted into the vagina, so it is difficult to use, it is insanitary, and it causes a user to feel unpleasant and restrains the user's freedom of movement.

DISCLOSURE OF THE INVENTION

Accordingly, the present invention has been made keeping in mind the above problems occurring in the prior art, and an object of the present invention is to provide a sphincter exerciser, which strengths the sphincter to prevent conditions, such as aconuresis or encopresis caused by weak sphincters resulting from pregnancy, childbirth, and increasing age, and which is designed in such a way as not to be inserted into the vagina, thus being sanitary and ensuring the freedom of movement, and which has a simple construction, thus being convenient as well as easy to use and handle, and which is designed to adjust momentum according to a user's physical condition.

In order to accomplish the above object, the present invention provides a sphincter exerciser, comprising a body consisting of two depressions formed on a top surface of the body in such a way as to be symmetrical with each other and to have a predetermined depth, the two depressions each having an inclined bottom, two hinge holes each formed on the top surface of the body at a position spaced from an associated depression by a predetermined distance, and a window having a triangular shape; two footholds each having a rectangular plate shape and a foot holding piece of a predetermined height formed at at least one position on the foothold, with a roller bracket downwardly formed at a position on a bottom surface of the foothold, and a hinge shaft having a hook piece and downwardly formed on the bottom surface of the foothold at a position spaced apart from the roller bracket; a roller shafted to the roller bracket of each of the footholds by means of a pin; and a momentum adjuster consisting of an adjusted block installed to be moved along a screw shalt mounted to a momentum adjusting piece, the screw shaft supported by shaft bearings at both ends thereof and said momentum adjusting piece knurled around an outer circumference thereof, with two guide rollers mounted at two positions of the adjusting block in such a way that the guide rollers are symmetric with each other, and a momentum display panel having a predetermined color and attached to a position around the guide rollers, find a coil spring connected at its first end to the body while connected at its second end to a wire extending from the hinge shafts of the two footholds at both ends thereof and passing over the two guide rollers.

According to this invention, a sliding member and a stationary member are mounted to the hinge shaft of each of the footholds, and the momentum adjuster comprises a hydraulic damper having a piston rod connected to the wire.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
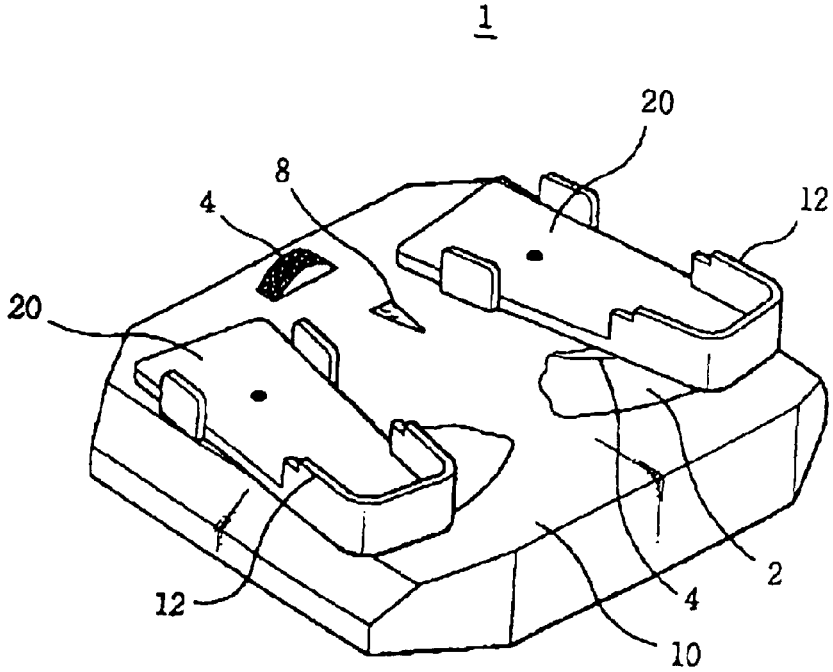
FIG. 1 is a perspective view showing a sphincter exerciser according to the primary embodiment of this invention.

Reference should now be made to the drawings, in which the same reference numerals are used throughout the different drawings to designate the same or similar components.

Figure 2:
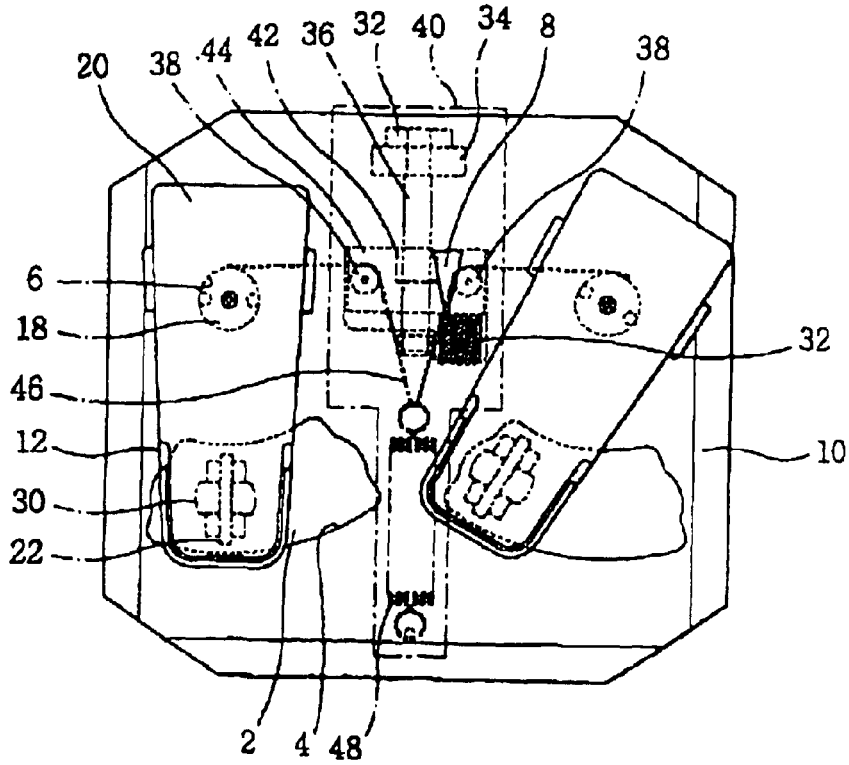
FIG. 2 is a plan view of the sphincter exerciser of this invention.
Figure 3:
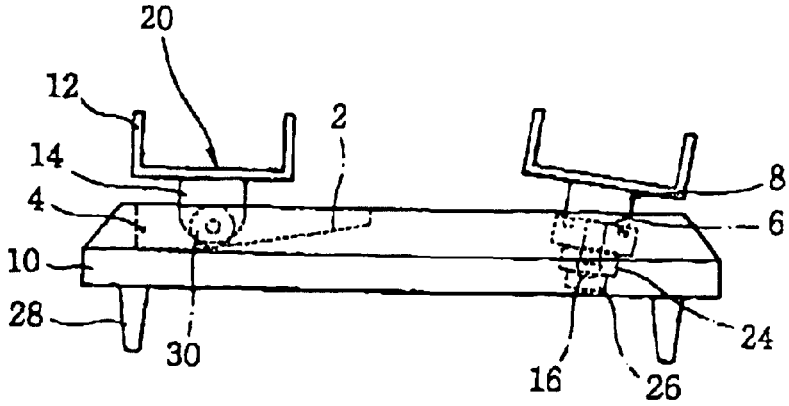
FIG. 3 is a sectional view of the sphincter exerciser of this invention.

As shown in FIGS. 1 to 3, the sphincter exerciser 1 includes a body 10, two footholds 20, a roller 30, and a momentum adjuster 40. The body 10 consists of two depressions 4, two hinge holes 6, and a window 8. The two depressions 4 are formed on the top surface or the body 10 in such a way as to be symmetrical with each other and to have it predetermined depth. Also, the two depressions 4 each have an inclined bottom 2. The two hinge holes 6 each are formed on the top surface of the body 10 at a position spaced from an associated depression 4 by a predetermined distance. The window 8 has an inverted triangular shape. In addition, the two footholds 20 each have a rectangular plate shape and a foot holding piece 12 of a predetermined height formed at at least one position on the foothold 20. In this case, a roller bracket 14 is downwardly formed at a position on the bottom surface of the foothold 20, and a hinge shaft 18 has a hook piece 16 and is downwardly formed on the bottom surface of the foothold 20 at a position spaced apart from the roller bracket 14. The roller 30 is shafted to the roller bracket 14 of each foothold 20 by means of a pin 22. Further, the momentum adjuster 40 consists of an adjusting block 44, and a coil spring 48. In this case, the adjusting block 44 is moved along with a screw shaft 36. The screw shaft 36 is supported by shaft bearings 32 at both ends thereof, and is mounted to a momentum adjusting piece 34 knurled around its outer circumference. Two guide rollers 38 are mounted at two positions of the adjusting block 44 in such a way that the guide rollers 38 are symmetrical with each other. A momentum display panel 42 with a predetermined color is attached to a position around the guide rollers 38. The coil spring 48 is connected at its one end to the body 10 while being connected at its other end to a wire 46. In this case, the wire 46 extends from the hinge shafts 18 of the two footholds 20 at both ends thereof and passes over the two guide rollers 38.

In this case, a sliding member 24 and a stationary member 26 are mounted to the hinge shaft 18 of each of the footholds 20.

FIG. 2 is a plan view of the sphincter exerciser of this invention. In FIG. 2, one of the two footholds 20 is provided on the body 10 by fitting, the hinge shaft 18 of the foothold 20 into the hinge hole 6 formed at a position oil the body 10 and laying the roller 30 of the foothold 20 on the inclined bottom 2 of the depression 4. On the contrary, the other foothold 20 is provided on the body 10 by fitting the hinge shaft 18 of the foothold 20 into the hinge hole 6 formed at a position on the body 10 in the same manner as described above, but this foothold 20 is rotated about the hinge shaft 18 at an angle of 40°. FIG. 3 is a sectional view of the sphincter exerciser of this invention. In FIG. 3, the roller 30 of the foothold 20 is laid on the depression 4 formed on the body 10. Further, the hinge shaft 18 downwardly projected from the foothold 20 is fitted into the hinge hole 6 formed at a position spaced apart from the roller 30, by means of the sliding member 24 and the stationary member 26. When the foothold 20 is rotated about the hinge shaft 18 at an angle of 40° as shown in FIG. 2, the foothold 20 is inclined at the same angle as that of the inclined bottom 2.

Figure 4:
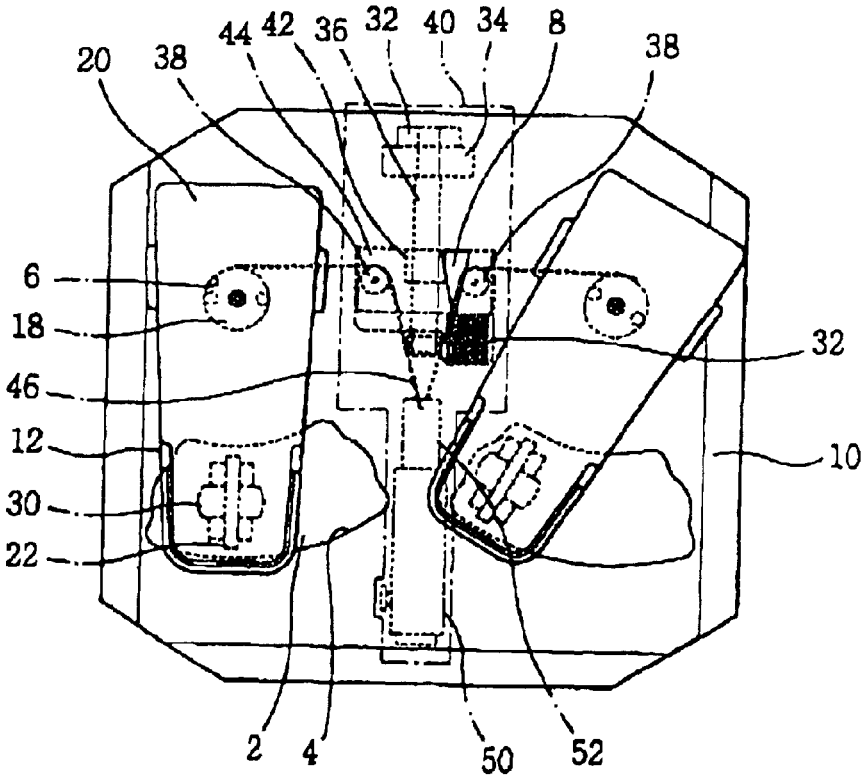
FIG. 4 is a plan view of a sphincter exerciser in accordance with the second embodiment of this invention.

FIG. 4 is a plan view of a sphincter exerciser in accordance with the second embodiment of this invention. According to the second embodiment, a means for adjusting momentum of the sphincter exerciser, that is, the momentum adjuster 40, has a hydraulic damper 50 with a piston rod 52 to adjust the momentum of the sphincter exerciser by a hydraulic pressure. In this case, the piston rod 52 is connected to the wire 46 used for adjusting momentum.

In FIG. 3, reference numeral 28 denotes a leg.

The operation of the sphincter exerciser according to this invention will be described in the following.

As shown in FIGS. 1 to 3, the sphincter exerciser 1 includes the body 10, the two footholds 20, the roller 30, and the momentum adjuster 40. The body 10 consists of the two depressions 4, the two hinge holes 6, and the window 8. The two depressions 4 are formed on the top surface of the body 10 in such a way as to be symmetrical with each other and to have a predetermined depth. Also, the two depressions 4 each have the inclined bottom 2. The two hinge holes 6 each are formed at the top surface of the body 10 at a position spaced from an associated depression 4 by a predetermined distance. The window 8 has an inverted triangular shape. In addition, the two footholds 20 each have a rectangular plate shape and the foot holding piece 12 of a predetermined height formed at at least one position on the foothold 20. In this case, the roller bracket 14 is downwardly formed at a position on the bottom surface of the foothold 20, and the hinge shaft 18 has the hook piece 16 and is downwardly formed on the bottom surface of the foothold 20 at a position spaced apart from the roller bracket 14. The roller 30 is shafted to the roller bracket 14 of each foothold 20 by means of the pin 22. Further, the momentum adjuster 40 consists of the adjusting block 44, and the coil spring 48. In this case, the adjusting block 44 is installed to be moved along with the screw shaft 36. The screw shaft 36 is supported by the shaft bearings 32 at both ends thereof, and is mounted to the momentum adjusting piece 34 knurled around its outer circumference. The two guide rollers 38 are mounted at two positions of the adjusting block 44 in such a way that the guide rollers 38 are symmetrical with each other. The momentum display panel 42 having a predetermined color is attached to a position around the guide rollers 38. The coil spring 48 is connected at its one end to the body 10 while being connected at its other end to the wire 46. When it is desired to perform exercises for strengthening the sphincter using the sphincter exerciser constructed in this way, a user first puts his/her foot on the footholds 20 provided on the body 10.

In this state, when the user exerts force to rotate his feet about the heels for making each foothold 20 rotate about the hinge shaft 18 at an angle of 40°, the roller 30 shafted to the roller bracket 14 of the foothold 20 is rotated along the inclined bottom 2. Meanwhile, when the user relaxes, the foothold 20 is rotated in a reverse direction by the inclination of the inclined bottom 2 to return to its original position.

In this case, the user must exert force on his heels in order to rotate the footholds 20 at an angle of 40°. At this time, the user inevitably constricts his sphincter. While using the sphincter exerciser 1, the user's sphincter is repeatedly constricted and relaxed, thus naturally performing exercise for strengthening the sphincter.

As such, while exercising for strengthening the sphincter, the intensity of exercise, that is, the momentum is adjusted by the momentum adjuster 40. The process of adjusting the momentum is as follows. First, when the momentum adjusting piece is turned in a predetermined direction, the screw shaft 36 supported in the body 10 by the shalt bearings 32 is rotated in a direction. At this time, the adjusting block 44 provided with the screw shaft 36 moves forward or rearward to adjust the tension of the coil spring 48 connected to the wire 46, thus adjusting the momentum of the sphincter exerciser 1 as desired.

In this case, the wire 46 connected to the coil spring 48 passes over the two guide rollers 38 positioned in the adjusting block 44. Thus, when the wile 46 is tensioned by the guide rollers 38 while the adjusting block 44 moves forward or rearward, the coil spring 48 connected to the wire 46 is tensioned and has an increased tension. At this time, in order to rotate the foothold 20, a stronger force corresponding to the increased tension is required, thus requiring a user to apply a larger amount of force.

In this way, the exercise for strengthening the sphincter is carried out by repeatedly and continuously rotating the footholds 20. The momentum adjusted by the momentum adjuster 40 can be confirmed through the window 8 formed on the body 10, because the momentum display panel 42 moves along with the adjusting block 44 as the adjusting block 44 moves forward or rearward along the screw shaft 36. Thus, a user can easily check the momentum.

As shown in FIG. 4, if the momentum adjuster 40 of the sphincter exerciser adjusts the momentum using a hydraulic damper 50 operating by a hydraulic action, then the momentum can be adjusted more precisely. Further, a scale (not shown) may be installed in the body 10.

Industrial Applicability

As described above, the present invention provides a sphincter exercise, which allows a user to perform exercises for strengthening the sphincter systematically and in stages, thus preventing conditions, such as aconuresis or encopresis caused by weak sphincters resulting from pregnancy, childbirth, and increasing age, therefore promoting health, and which has a simple construction, thus being convenient as well as easy to use and handle, and thus being efficient.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sphincter exerciser comprising:

a body consisting of:

two depressions formed on a top surface of the body in such a way as to be symmetrical with each other and to have a predetermined depth, said two depressions each having an inclined bottom;

two hinge holes each formed on the top surface of the body at a position spaced from an associated depression by a predetermined distance; and a window having a triangular shape;

two footholds each having a rectangular plate shape and a foot folding piece of a predetermined height formed at at least one position on the foothold, with a roller bracket downwardly formed at a position on a bottom surface of the foothold, and a hinge shaft having a hook piece and being downwardly formed on the bottom surface of the foothold at a position spaced apart from said roller bracket;

a roller shafted to the roller bracket of each of the footholds by means of a pin; and a momentum adjuster consisting of:

an adjusting block installed to be moved along a screw shaft mounted to a momentum adjusting piece, said screw shaft supported by shaft bearing at both ends thereof and said momentum adjusting piece knurled around an outer circumference thereof, with two guide rollers mounted at two positions of the adjusting block in such a way that the guide rollers are symmetrical with each other, and a momentum display panel having a predetermined color and attached to a position around the guide rollers; and a coil spring connected at a first end thereof to said body while connected at a second end thereof to a wire extending from the hinge shafts of the two footholds at both ends thereof and passing over the two guide rollers.

2. The sphincter exerciser according to claim 1, wherein a sliding member and a stationary member are mounted to the hinge shaft of each of the footholds.

3. The sphincter exerciser according to claim 1, wherein said momentum adjuster comprises a hydraulic damper, said hydraulic damper having a piston rod connected to said wire.

* * * * *